US011362461B2

(12) United States Patent
Tamaki

(10) Patent No.: US 11,362,461 B2
(45) Date of Patent: Jun. 14, 2022

(54) CONNECTOR HAVING MOVABLE HOUSINGS RESPECTIVELY HOLDING ONE ENDS OF TERMINALS

(71) Applicant: HIROSE ELECTRIC CO., LTD., Kanagawa (JP)

(72) Inventor: Shoichiro Tamaki, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/068,336

(22) Filed: Oct. 12, 2020

(65) Prior Publication Data

US 2021/0111517 A1 Apr. 15, 2021

(30) Foreign Application Priority Data

Oct. 15, 2019 (JP) ..... JP2019-188657

(51) Int. Cl.
*H01R 13/631* (2006.01)
*H01R 43/16* (2006.01)

(52) U.S. Cl.
CPC ..... *H01R 13/6315* (2013.01); *H01R 43/16* (2013.01)

(58) Field of Classification Search
CPC ..... H01R 12/91; H01R 13/6315; H01R 43/16
USPC ..... 439/246–248
See application file for complete search history.

(56) References Cited

U.S. PATENT DOCUMENTS 5,201,663 A * 4/1993 Kikuchi ..... H01R 13/6315 439/83
5,306,169 A * 4/1994 Fukushima ..... H01R 12/712 439/248
6,244,883 B1 * 6/2001 Ito ..... H01R 13/6315 439/247
6,347,950 B1 * 2/2002 Yokoyama ..... H01R 13/6315 439/248
6,409,550 B1 * 6/2002 Splichal ..... H01R 13/6315 439/289
6,830,469 B1 * 12/2004 Doyle ..... H01R 13/6273 439/247
7,186,126 B2 * 3/2007 Umehara ..... H01R 13/33 439/247
7,311,525 B2 * 12/2007 Koiwaya ..... H01R 35/02 439/131
7,922,539 B2 * 4/2011 Kubo ..... H01R 13/6477 439/620.21
8,033,851 B2 * 10/2011 Tanaka ..... H01R 12/724 439/248

(Continued)

FOREIGN PATENT DOCUMENTS

JP 2019-160698 A 9/2019

*Primary Examiner* — Marcus E Harcum
(74) *Attorney, Agent, or Firm* — Rankin, Hill & Clark LLP

(57) ABSTRACT

Provided is a connector including a plurality of terminals respectively corresponding to a plurality of mating terminals of a mating connector, a plurality of movable housings respectively holding one ends of the terminals respectively in contact with the plurality of mating terminals, and a fixed housing fixed to a mounting target and housing the plurality of movable housings. The other ends of the plurality of terminals are fixed to the fixed housing, and the plurality of terminals operate independently with respect to the plurality of mating terminals, and thus respectively support the plurality of movable housings movably with respect to the fixed housing.

2 Claims, 13 Drawing Sheets

(56) References Cited

U.S. PATENT DOCUMENTS 8,821,174 B2 * 9/2014 Kimura ..... H01R 13/6315 439/248
9,570,830 B2 * 2/2017 Yamada ..... H01R 13/20
9,735,531 B2 * 8/2017 Zhu ..... H01R 43/16
9,799,971 B2 * 10/2017 Ninomiya ..... H01R 13/6315
9,997,854 B2 * 6/2018 Kobayashi ..... H01R 12/91
10,454,202 B2 * 10/2019 Shimoji ..... H01R 13/05
10,522,927 B2 * 12/2019 Yoshida ..... H01R 12/91
10,553,980 B2 * 2/2020 Ogura ..... H01R 13/113
10,594,080 B2 * 3/2020 Sugiki ..... H01R 12/91
10,686,273 B2 * 6/2020 Ogura ..... H01R 12/91
2003/0232533 A1 * 12/2003 Burmeister ..... H01R 13/02 439/259
2006/0128198 A1 * 6/2006 Koga ..... H01R 12/724 439/247
2012/0302081 A1 * 11/2012 Daugherty ..... H01R 13/6315 439/248
2013/0017729 A1 * 1/2013 Kimura ..... H01R 13/6315 439/626
2014/0342614 A1 * 11/2014 Yukutake ..... H01R 12/91 439/626
2015/0288083 A1 * 10/2015 Kashiwada ..... H01R 4/38 439/247
2016/0111804 A1 * 4/2016 Saito ..... H01R 13/18 439/733.1
2016/0204536 A1 * 7/2016 Doi ..... H01R 13/6315 439/248
2016/0308311 A1 * 10/2016 Hori ..... H01R 13/7032
2017/0310048 A1 * 10/2017 Kato ..... H01R 13/518
2018/0076546 A1 * 3/2018 Tamai ..... H01R 12/91
2018/0358748 A1 * 12/2018 Yamanashi ..... H01R 24/62
2019/0148884 A1 * 5/2019 Sugiki ..... H01R 13/05 439/247
2019/0288440 A1 9/2019 Ogura
2019/0363491 A1 * 11/2019 Suzuki ..... H01R 13/187

* cited by examiner

CONNECTOR HAVING MOVABLE HOUSINGS RESPECTIVELY HOLDING ONE ENDS OF TERMINALS

CROSS-REFERENCE TO RELATED APPLICATION

This application claims priority from Japanese Patent Application No. 2019-188657 filed with the Japan Patent Office on Oct. 15, 2019, the entire content of which is hereby incorporated by reference.

BACKGROUND

1. Technical Field

One aspect of the present disclosure relates to a connector having a floating function.

2. Related Art

Some connectors have a floating function. The floating function means that even when a mating connector is misaligned with the connector, the connector absorbs misalignment and enables connection between the connector and the mating connector, or maintains the connection between the connector and the mating connector.

The connector is provided with a terminal including a connecting portion connected to a circuit provided on a device or a substrate and a contact portion that contacts a mating terminal of the mating connector. Further, the connector having the floating function includes a fixed housing fixed to the device or the substrate and a movable housing movable with respect to the fixed housing. In the terminal of the connector, the connecting portion is fixed to the fixed housing, and the contact portion is fixed to the movable housing. The terminal of the connector is formed so that a portion between the connecting portion and the contact portion is elastically deformable, which allows the contact portion to move with respect to the fixed housing, so that the movable housing attached to the contact portion can move with respect to the fixed housing. In other words, the terminal of the connector supports the movable housing movably with respect to the fixed housing.

For example, a movable connector described in JP-A-2019-160698 includes a first housing mounted on a substrate, a second housing movable with respect to the first housing, and one or a plurality of terminals. The terminal has a movable portion that supports the second housing movably with respect to the first housing, and a contact portion that is in conductive contact with an object to be connected. The contact portion has a contact piece, a right pressing support piece, and a left pressing support piece, and the right pressing support piece and the left pressing support piece (the support pieces) are connected to the contact piece via a right connecting piece and a left connecting piece (connecting pieces).

SUMMARY

A connector according to the present invention includes a plurality of terminals respectively corresponding to a plurality of mating terminals of a mating connector, a plurality of movable housings respectively holding one ends of the plurality of terminals respectively in contact with the plurality of mating terminals, and a fixed housing fixed to a mounting target and housing the plurality of movable housings. The other ends of the terminals are fixed to the fixed housing, and the plurality of terminals operates independently with respect to the plurality of mating terminals, and thus respectively support the plurality of movable housings movably with respect to the fixed housing.

DETAILED DESCRIPTION

Figure 1:
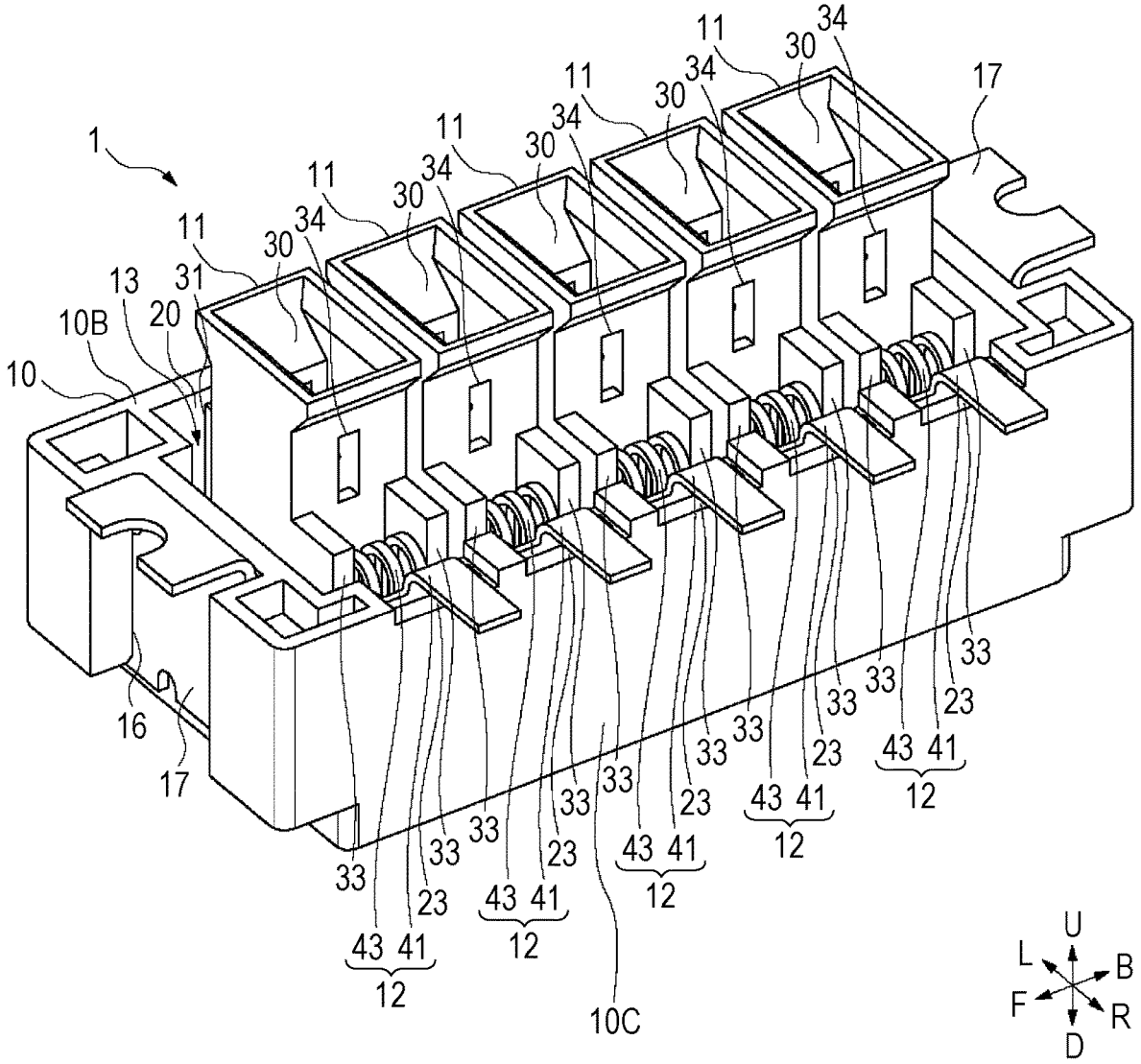
FIG. 1 is a perspective view illustrating a connector of an embodiment of the present invention from an upper right side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Conventionally, a connector having a floating function includes a movable housing corresponding to a mating connector in a one-to-one correspondence, and the movable housing moves in response to misalignment of the mating connector. Incidentally, the mating connector may include a plurality of mating terminals, and in that case, the movable housing needs to include a plurality of terminals respectively corresponding to the mating terminals. However, when the movable housing moves in response to misalignment of one mating terminal in one direction, it cannot accommodate the misalignment of another mating terminal in another direction. Therefore, when some of the mating terminals are displaced in different directions from each other, the mating terminals cannot be brought into contact with the terminals, and the connector cannot be connected to the mating connector.

In the connector having the floating function, the terminal may be formed by bending a conductor member such as a metal. The terminal can be made elastically deformable by using the conductor member extending in a predetermined direction from a connecting portion to a contact portion and by bending portions between the connecting portion and the contact portion a plurality of times to form a spring portion. For example, as in JP-A-2019-160698, the terminal can contact the mating terminal at multiple points by forming the contact portion by facing a contact piece and a support piece. The contact piece and the support piece are arranged in a direction intersecting a predetermined direction from the connecting portion to the contact portion, and are bent to each other.

However, in the terminal, the contact piece and the support piece are connected laterally with respect to an insertion direction of the mating terminal via the connecting piece. Therefore, the support piece may be deformed such that its end portion on a non-connected side is separated from the contact piece. At this time, the mating terminal cannot be brought into contact with the terminal, and the connector cannot be connected to the mating connector.

Further, in the terminal, it is necessary to use the conductor member extending not only in the direction from the connecting portion to the contact portion via the spring portion but also in a direction in which the contact piece and the support piece are arranged. Therefore, since it is necessary to bend the conductor member in various directions, work efficiency is reduced. Further, the conductor member requires a large area in multiple directions. Therefore, when a plurality of conductor members are produced from one conductor flat plate, since the number of produced conductor members cannot be increased, production efficiency and production cost of the terminal are reduced.

The present invention has been made in view of, for example, the above-described problems, and an object of the present invention is to provide the connector that addresses the misalignment of the mating terminals. Another object of the present invention is to provide the connector in which the terminals corresponding to the mating terminals are easily formed.

In order to solve the above problems, the connector according to the present invention includes a plurality of terminals respectively corresponding to a plurality of mating terminals of a mating connector, a plurality of movable housings respectively holding one ends of the terminals respectively in contact with the mating terminals, and a fixed housing fixed to a mounting target such as a substrate and housing the movable housings. The other ends of the terminals are fixed to the fixed housing, and the terminals respectively support the movable housings movably with respect to the fixed housing.

In the connector of the present invention, it is preferred that each of the terminals is formed by bending a conductor strip in its short direction at a plurality of positions in its longitudinal direction, to form a contact portion urged to a side closer to each of the mating terminals.

Further, in the connector of the present invention, it is preferred that the contact portion has a first branch piece, and two second branch pieces on both sides of the first branch piece, that are obtained by branching the conductor strip into three branches, and a contact piece that the two second branch pieces join, the first branch piece and the contact piece respectively have a first contact point portion and a second contact point portion that contact the mating terminals, the second branch pieces are formed to be longer than the first branch piece in the longitudinal direction, and the first branch piece and the second branch pieces are bent in different directions so as to be separated from each other, and then bent so that the first contact point portion and the second contact point portion are brought close to each other. Furthermore, in the connector of the present invention, it is preferred that the movable housings are formed so that the mating terminals can be inserted thereinto, and the two second branch pieces are provided to be separated wider than a width of each of the mating terminals in the short direction.

Advantage of the Invention

According to the present invention, it is possible to address the misalignment of the mating terminals, and to easily form the terminals corresponding to the mating terminals.

A connector 1 according to an embodiment of the present invention will be described with reference to the drawings. Regarding the embodiment of the present invention, when describing directions of up (U), down (D), front (F), back (B), left (L) and right (R), for convenience of description, follow arrows illustrated in FIGS. 1 to 10, 12 and 13.

Figure 2:
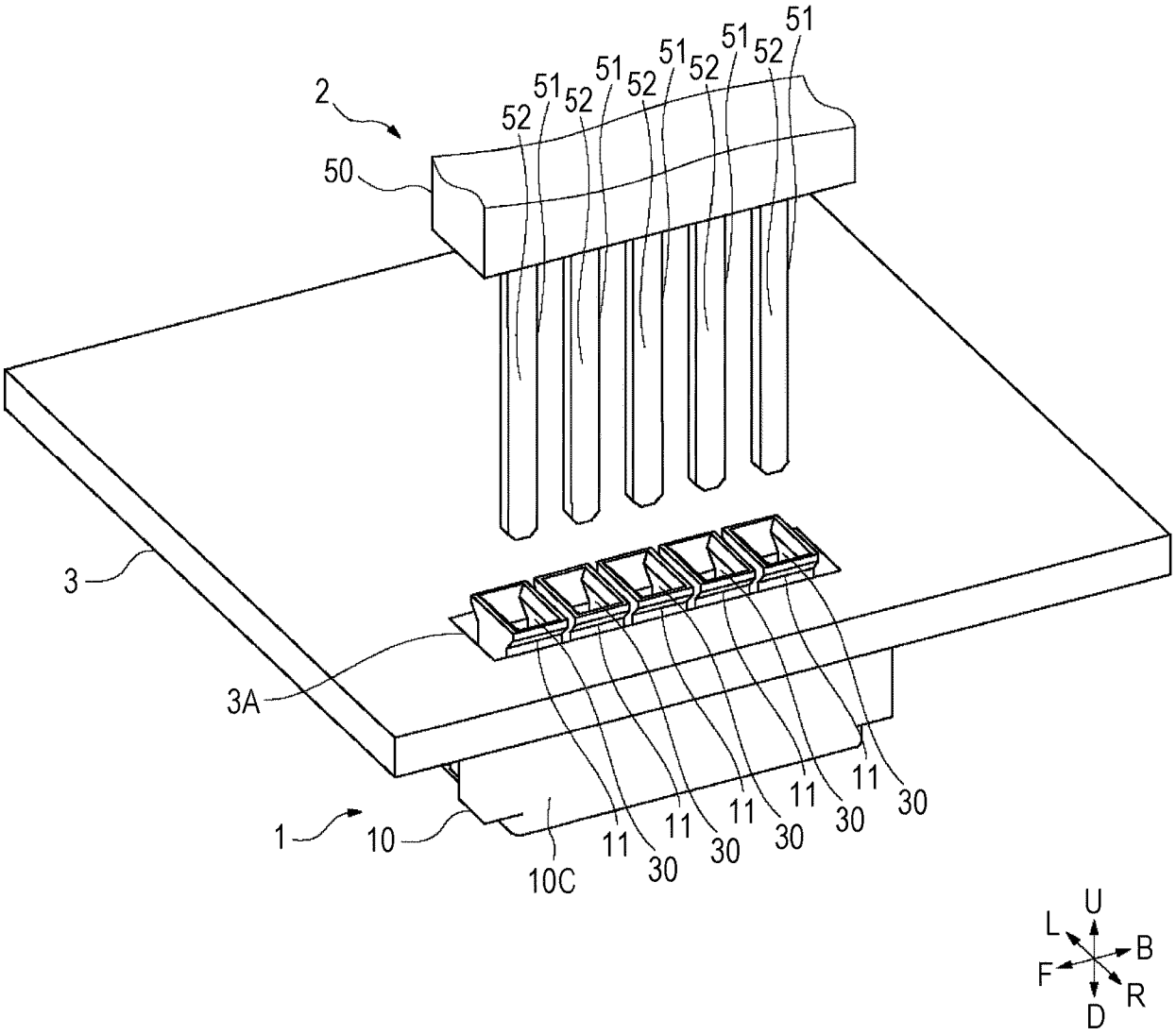
FIG. 2 is a perspective view illustrating a mating connector connected to the connector of the embodiment of the present invention from the upper right side.

FIG. 1 is a perspective view of the connector 1 as seen from an upper right side, and FIG. 2 is a perspective view of a mating connector 2 connectable to the connector 1 as seen from the upper right side. The connector 1 according to the embodiment of the present invention is configured to have the floating function.

The connector 1 is, for example, a socket or the like mounted on a substrate 3, and the mating connector 2 is, for example, an electronic component such as an insulated gate bipolar transistor (IGBT), or a connector incorporating the IGBT, an IC, or another electronic component. If the connector 1 is connected to a circuit provided on the substrate 3, the connector 1 and the mating connector 2 are connected to each other, so that the mating connector 2 is connected to the circuit. The mounting target on which the connector 1 is mounted is not limited to the substrate 3, but may be an electronic device or an electric device.

The mating connector 2 will be described. As illustrated in FIG. 2, the mating connector 2 includes a mating housing 50 and a plurality of mating terminals 51. The mating housing 50 is formed of an insulating material such as a synthetic resin. FIG. 2 illustrates an example in which the mating connector 2 includes five mating terminals 51, but the number of the mating terminals 51 can be adjusted according to a function of the mating connector 2, and the mating connector 2 may include four or less or six or more mating terminals 51.

The mating terminals 51 are formed of a conductive material such as a metal, are arranged, for example, at predetermined intervals in a front-back direction with respect to the mating housing 50, and are provided to project downward from an inside of the mating housing 50. The mating terminals 51 are provided, for example, near a center in a left-right direction. In the present embodiment, an example in which the mating terminals 51 are arranged in a row will be described, however, they may be arranged in a plurality of rows in the left-right direction. In the present embodiment, the example in which the mating terminals 51 are formed to be longer than the connector 1 in an up-down direction will be described, however, the mating terminals 51 may be formed to be shorter than the connector 1 in the up-down direction as long as the mating terminals 51 respectively reach terminals 12 of the connector 1.

A contact portion 52 is formed on a surface of the mating terminal 51 projecting downward from the mating housing 50, and when the connector 1 and the mating connector 2 are connected, the contact portion 52 contacts a contact portion 44 (see FIGS. 4 to 6) of the terminal 12 of the connector 1, that is, the mating terminals 51 respectively contact the terminals 12.

Figure 3:
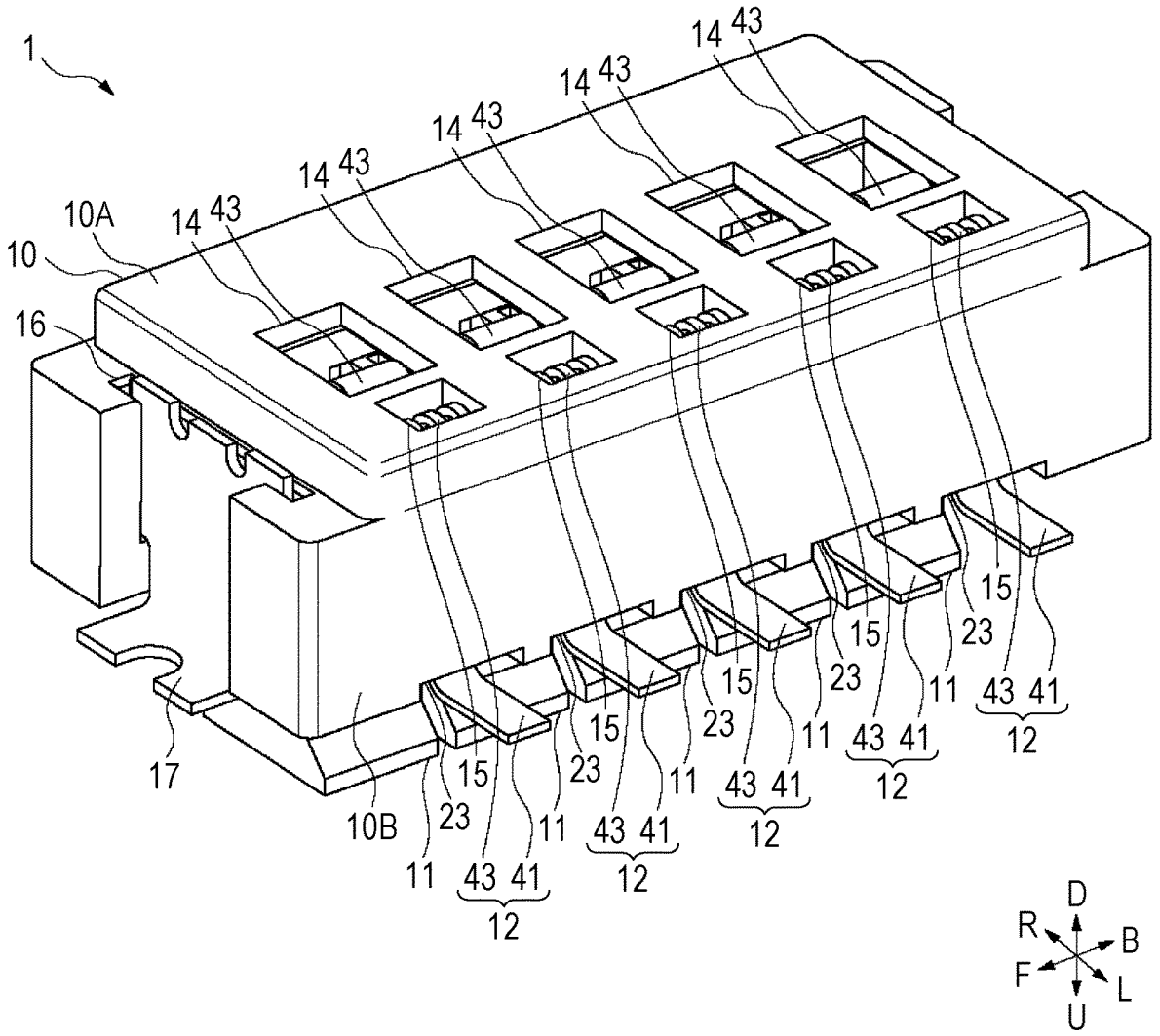
FIG. 3 is a perspective view illustrating the connector of the embodiment of the present invention from a lower left side.
Figure 4:
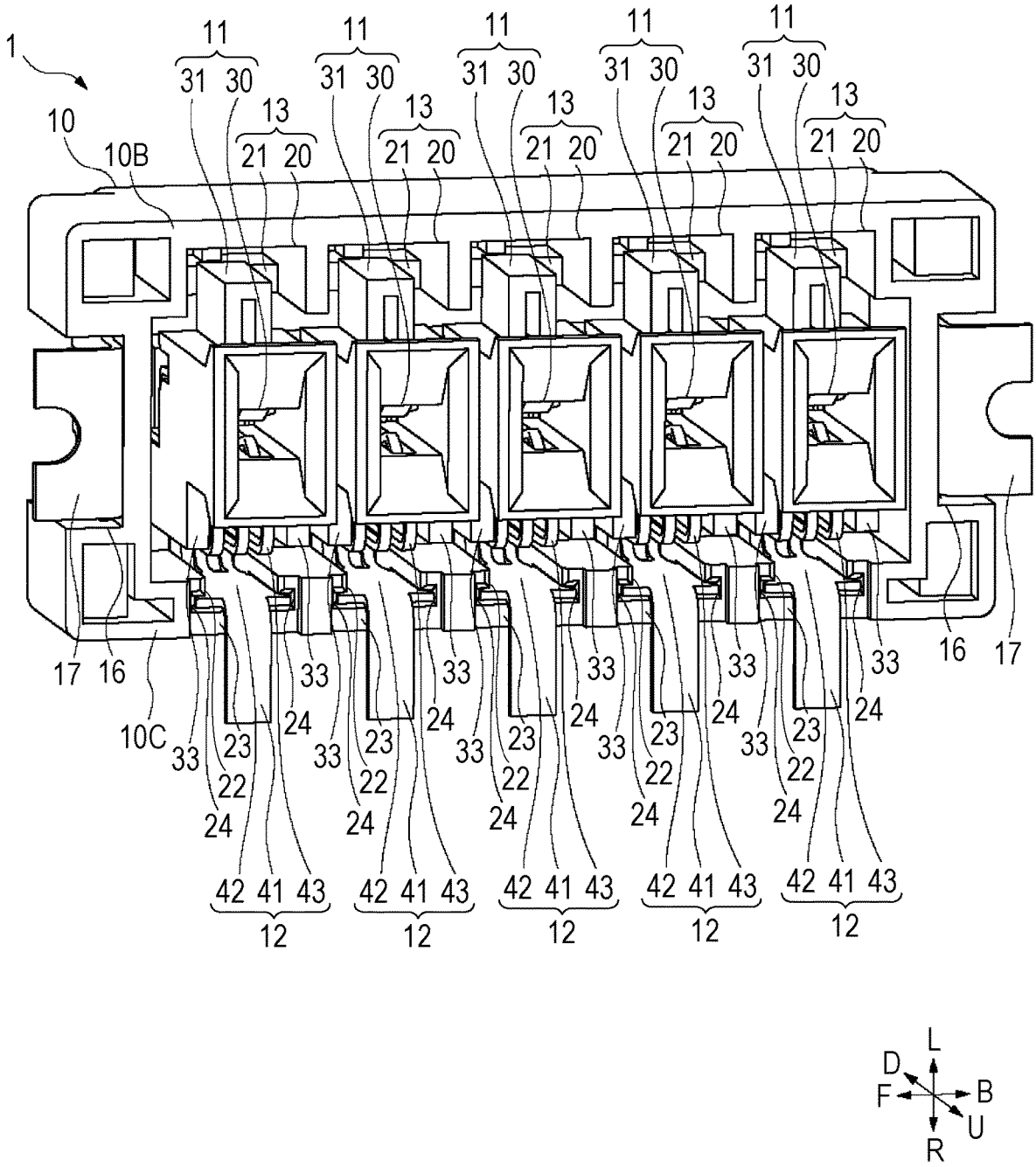
FIG. 4 is a perspective view illustrating the connector of the embodiment of the present invention from above.
Figure 5:
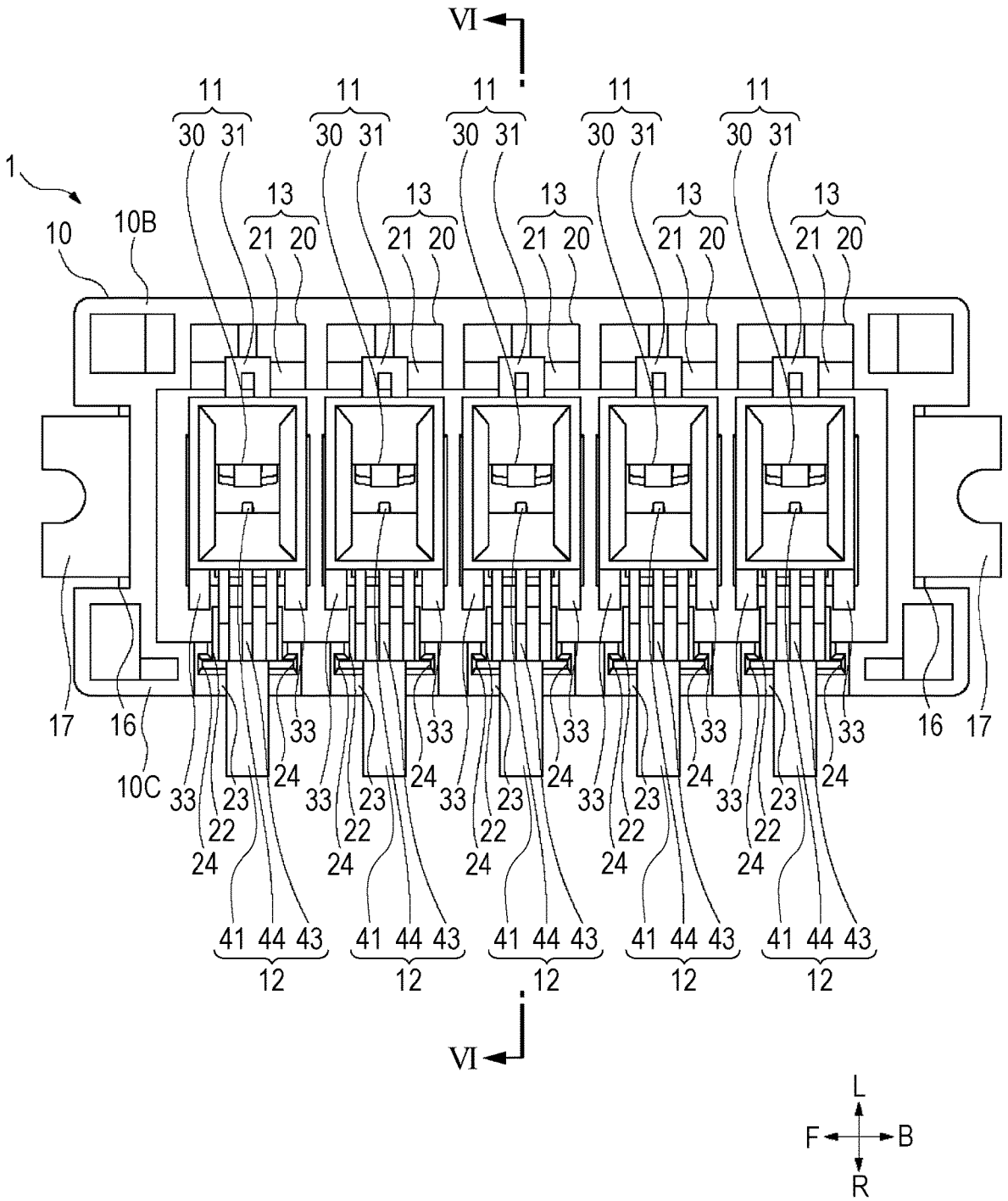
FIG. 5 is a plan view illustrating the connector of the embodiment of the present invention.
Figure 6:
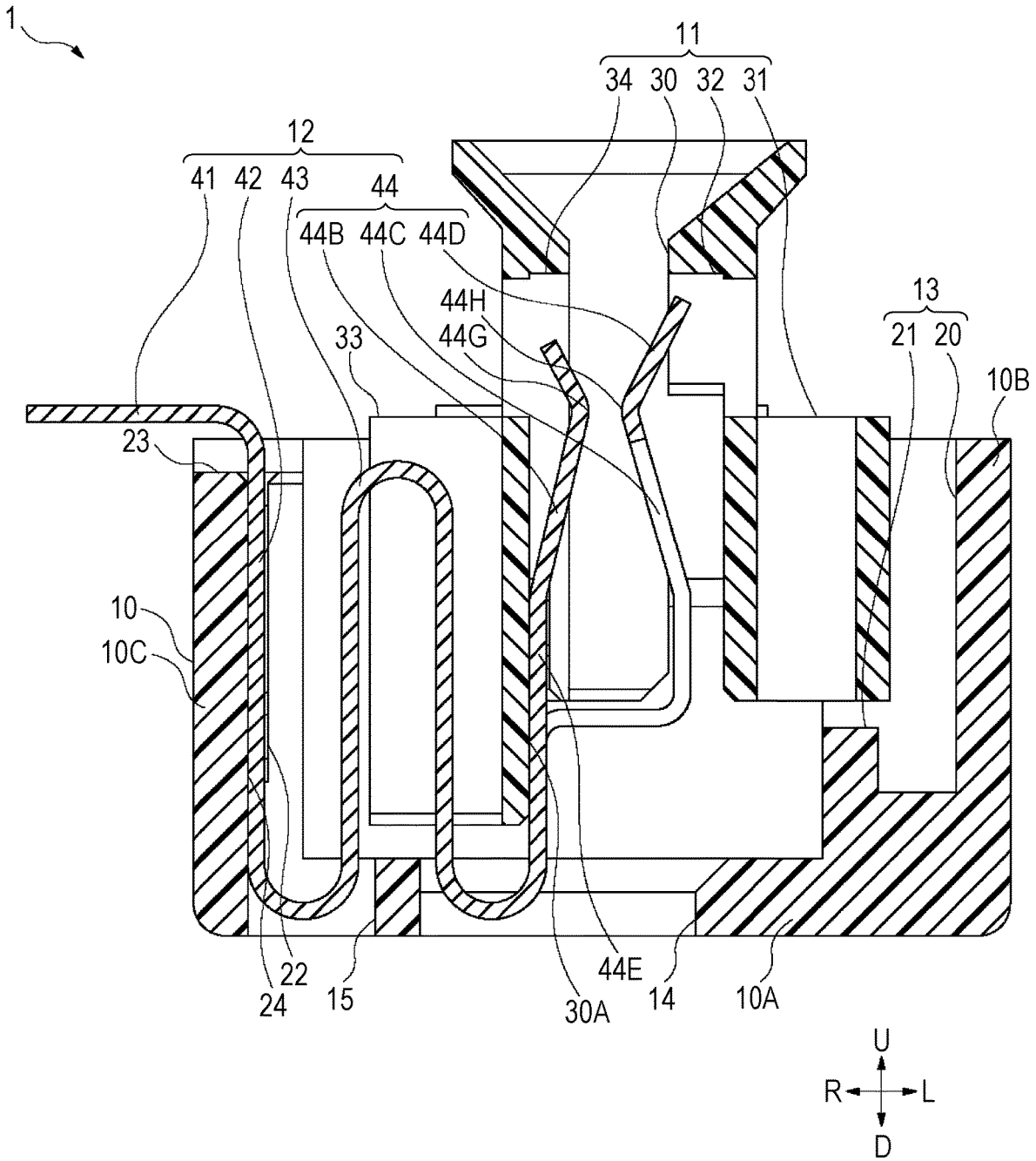
FIG. 6 is a cross-sectional view illustrating the connector as seen from a direction of an arrow VI-VI in FIG. 5.

The connector 1 will be described. FIG. 3 is a perspective view of the connector 1 as seen from a lower left side, and FIG. 4 is a perspective view of the connector 1 as seen from above. FIG. 5 is a plan view of the connector 1, and FIG. 6 is a cross-sectional view taken along a line VI-VI of FIG. 5.

As illustrated in FIGS. 1 and 3 to 6, the connector 1 includes a fixed housing 10, a plurality of movable housings 11, and the terminals 12. The connector 1 is attached by fixing the fixed housing 10 housing the movable housings 11 and the terminals 12 to the mounting target such as the substrate 3. The connector 1 of the present embodiment is configured to be attached to the substrate 3 from below, and is attached by aligning an upper end of an insertion portion 30 of the movable housing 11 with a position of an opening 3A provided in the substrate 3. For example, the upper end of the movable housing 11 projects upward of the fixed housing 10 and is inserted into the opening 3A of the substrate 3 from below. In the drawings, an example will be described in which the connector 1 includes five movable housings 11 and five terminals 12, corresponding to the five mating terminals 51 of the mating connector 2, however, the number of the movable housings 11 and the number of the terminals 12 are adjustable according to the number of the mating terminals 51 of the mating connector 2, and the connector 1 may include four or less or six or more movable housings 11 and terminals 12. Further, the connector 1 may include more movable housings 11 and terminals 12 than the mating terminals 51.

Figure 7:
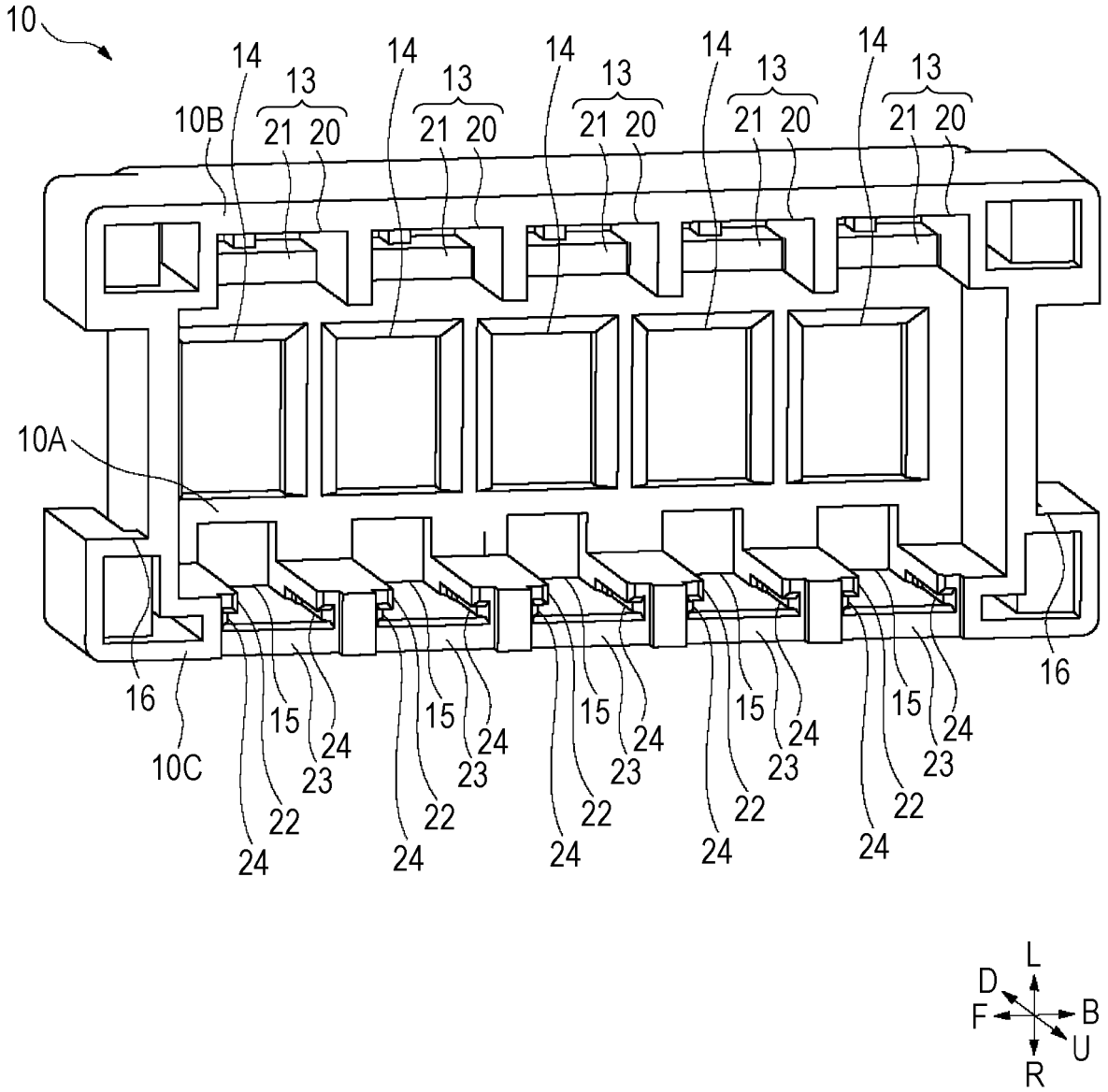
FIG. 7 is a perspective view illustrating a fixed housing of the connector of the embodiment of the present invention from above.

The fixed housing 10 is formed of, for example, the insulating material such as the synthetic resin, in a substantially box shape with an upper surface opened. FIG. 7 is a perspective view of the fixed housing 10 as seen from above. Inside the fixed housing 10, a plurality of housing portions 13 respectively housing the movable housings 11 and the terminals 12 are formed, and as illustrated in FIGS. 1 and 3 to 6, connecting portions 41 of the terminals 12 are fixed.

A bottom plate 10A of the fixed housing 10 is formed with a plurality of through-holes 14 respectively communicating with the housing portions 13, and is formed with a plurality of spring housing holes 15. Fitting mounting portions 16 for mounting fixing fittings 17 are respectively formed at a center of a lower portion of a front surface in the left-right direction and a center of a lower portion of a back surface in the left-right direction of the fixed housing 10. The fixed housing 10 is fixed to the substrate 3 by the fixing fittings 17 attached to the fitting mounting portions 16 on the front and back.

With respect to the fixed housing 10, the terminals 12 are arranged, for example, at predetermined intervals in the front-back direction, corresponding to an arrangement of the mating terminals 51 of the mating connector 2. Further, with respect to the fixed housing 10, the movable housings 11 respectively attached to the contact portions 44 of the terminals 12 are arranged, for example, at predetermined intervals in the front-back direction, corresponding to the arrangement of the terminals 12. The housing portions 13 of the fixed housing 10 are arranged, for example, at predetermined intervals in the front-back direction, corresponding to the arrangement of the movable housings 11 and the terminals 12.

Similar to the housing portions 13, the through-holes 14 and the spring housing holes 15 are also arranged, for example, at predetermined intervals in the front-back direction, corresponding to the arrangement of the movable housings 11 and the terminals 12. The through-holes 14 are arranged, for example, near the center in the left-right direction, respectively corresponding to the mating terminals 51 of the mating connector 2. In the present embodiment, an example will be described in which the spring housing holes 15 penetrate in the up-down direction corresponding to the mating terminals 51 penetrating the connector 1 in the up-down direction, however, in the case where the mating terminals 51 do not penetrate the connector 1 in the up-down direction, the spring housing holes 15 may be provided to be recessed inside the fixed housing 10.

As illustrated in FIG. 7, the housing portions 13 are provided to be recessed downward from an upper surface of the fixed housing 10. The housing portions 13 respectively have spaces for movably housing the movable housings 11 and the terminals 12. In the present embodiment, as illustrated in FIGS. 1, 4, 5 and 7, an example in which the housing portions 13 communicate with each other over the front-back direction will be described, however, the housing portions 13 may be partitioned by providing walls upright from the bottom plate 10A of the fixed housing 10. Since the housing portions 13 have the same configuration, one housing portion 13 will be described below.

On an inner surface of a left wall 10B of the fixed housing 10 that forms the housing portion 13, a left recess 20 that houses a left protrusion 31 of the movable housing 11 is formed. The left recess 20 penetrates upward, while a lower restricting portion 21 is formed in a lower portion of the left recess 20.

In a state in which the movable housing 11 is not moving, the left protrusion 31 is disposed to be separated upward from the lower restricting portion 21, and separated from a front inner surface and a back inner surface of the left recess 20, and further separated from a left inner surface to a right side of the left recess 20. The lower restricting portion 21 restricts downward movement of the movable housing 11 to a predetermined amount, the front inner surface and the back inner surface of the left recess 20 restricts the movement of the movable housing 11 in the front-back direction to a predetermined amount, and the left inner surface of the left recess 20 restricts the movement of the movable housing 11 to a left side to a predetermined amount.

On an inner surface of a right wall 10C of the fixed housing 10 that forms the housing portion 13, a right recess 22 for supporting a support portion 42 of the terminal 12 is formed, and on an upper surface of the right wall 10C, an upper recess 23 for exposing the connecting portion 41 of the terminal 12 to the right side is formed. The right recess 22 penetrates in the up-down direction and communicates with the spring housing hole 15 on the lower side. Further, on upper portions of a front inner surface and a back inner surface of the right recess 22, a pair of front and back support grooves 24 for supporting the support portion 42 of the terminal 12 is formed. The pair of support grooves 24 faces each other and penetrate upward.

Figure 8:
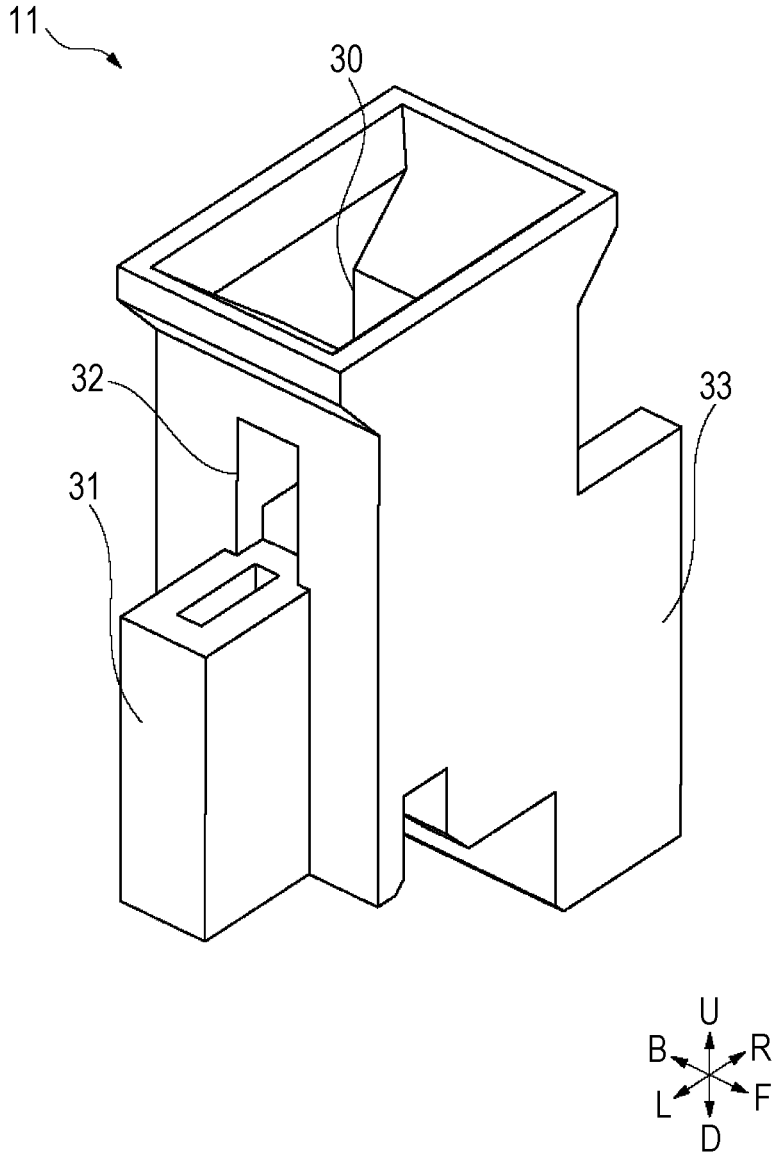
FIG. 8 is a perspective view illustrating a movable housing of the connector of the embodiment of the present invention from a left side.
Figure 9:
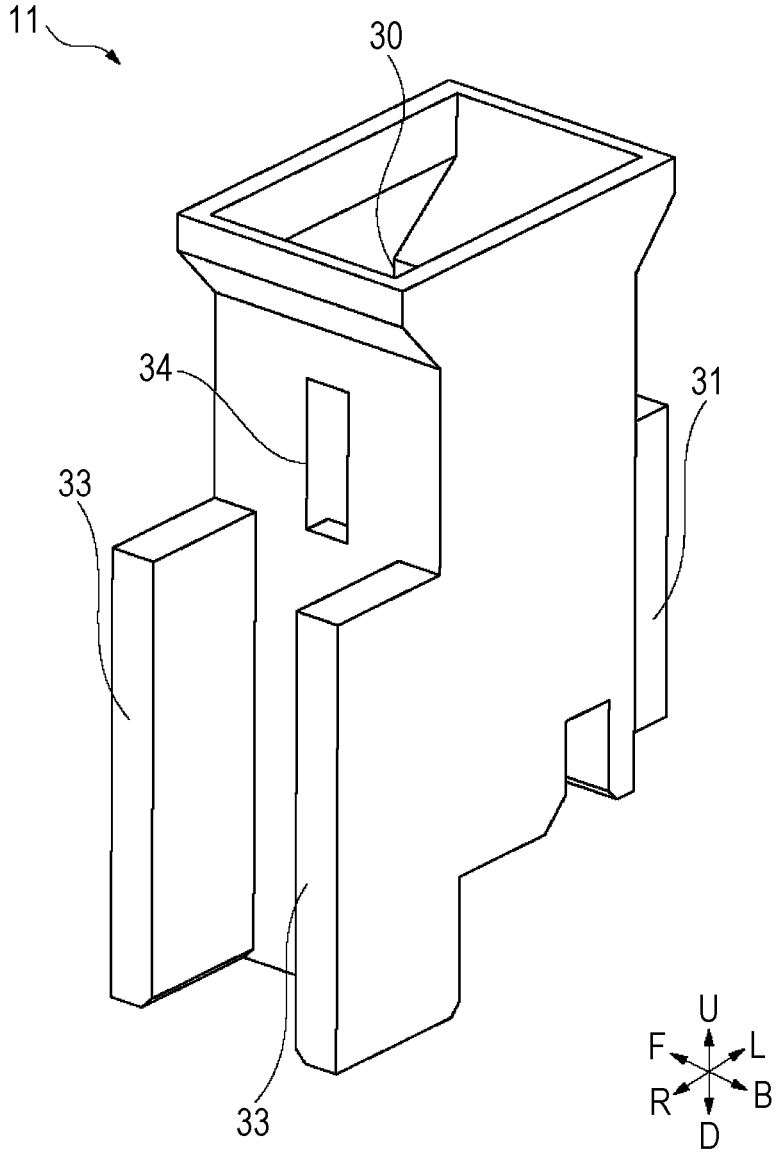
FIG. 9 is a perspective view illustrating the movable housing of the connector of the embodiment of the present invention from the left side.
Figure 10:
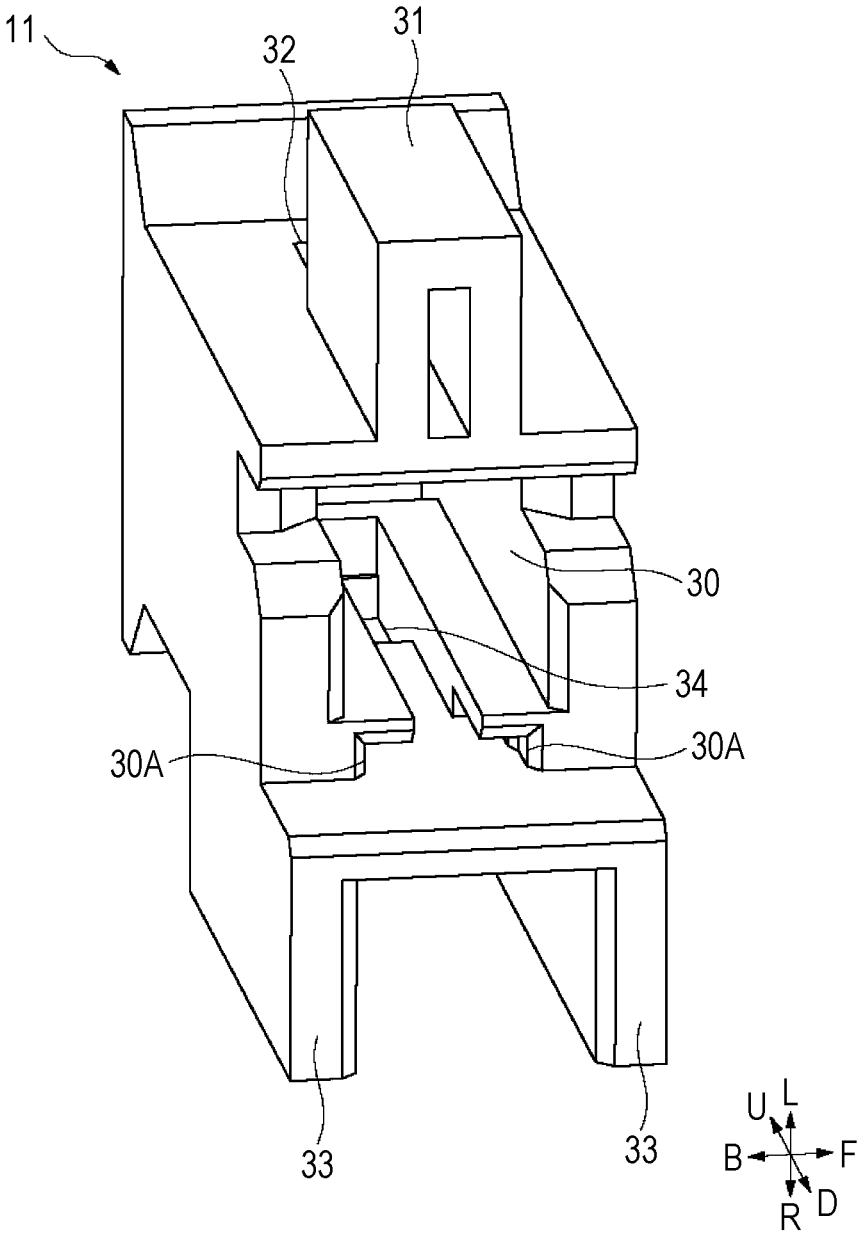
FIG. 10 is a perspective view illustrating the movable housing of the connector of the embodiment of the present invention from below.

Since the movable housings 11 have the same configuration, one movable housing 11 will be described below. The movable housing 11 is formed in a substantially rectangular tube shape by, for example, the insulating material such as the synthetic resin. FIG. 8 is a perspective view of the movable housing 11 as seen from the left side, FIG. 9 is a perspective view of the movable housing 11 as seen from the right side, and FIG. 10 is a perspective view of the movable housing 11 as seen from below. As illustrated in FIGS. 1, 6, 8 to 10, an outer surface and an inner surface of the upper end of the movable housing 11 are formed to be gradually widened from each other upward in the left-right direction.

As illustrated in FIGS. 8, 9 and 10, the movable housing 11 includes the insertion portion 30 that penetrates in the up-down direction, and the insertion portion 30 houses the contact portion 44 of the terminal 12 and the mating terminal 51 is inserted therein. The movable housing 11 is disposed so that the insertion portion 30 and the through-hole 14 of the fixed housing 10 correspond to each other to communicate with each other in the up-down direction. A pair of front and back locking grooves 30A that locks the contact portion 44 is formed in a lower portion of a right inner surface of the insertion portion 30. The pair of locking grooves 30A faces each other and penetrates downward.

The left protrusion 31 protruding leftward is formed on a lower portion of a left surface of the movable housing 11, and a left locking hole 32 for locking the contact portion 44 of the terminal 12 is formed on an upper portion of the left surface. A pair of front and back right protrusions 33 projecting rightward and downward is formed in a lower portion of a right surface of the movable housing 11, and a right locking hole 34 for locking the contact portion 44 of the terminal 12 is formed in an upper portion of the right surface. The left locking hole 32 and the right locking hole 34 communicate with the insertion portion 30.

The movable housing 11 is housed in the housing portion 13 of the fixed housing 10, and in particular, the left protrusion 31 is housed in the left recess 20 of the housing portion 13 as described above. When the movable housing 11 is not moving, the right protrusion 33 is disposed to be separated upward from the bottom plate 10A of the fixed housing 10. A separation distance of the right protrusion 33 from the bottom plate 10A is preferably set to be larger than a separation distance of the left protrusion 31 from the lower restricting portion 21.

In the present embodiment, an example will be described in which the upper end of the movable housing 11 projects upward of the fixed housing 10 and the left protrusion 31 and the right protrusion 33 are housed in a state of projecting upward of the fixed housing 10, however, the entire left protrusion 31 and the entire right protrusion 33 may be housed inside the fixed housing 10, or the entire movable housing 11 may be housed inside the fixed housing 10.

Figure 11:
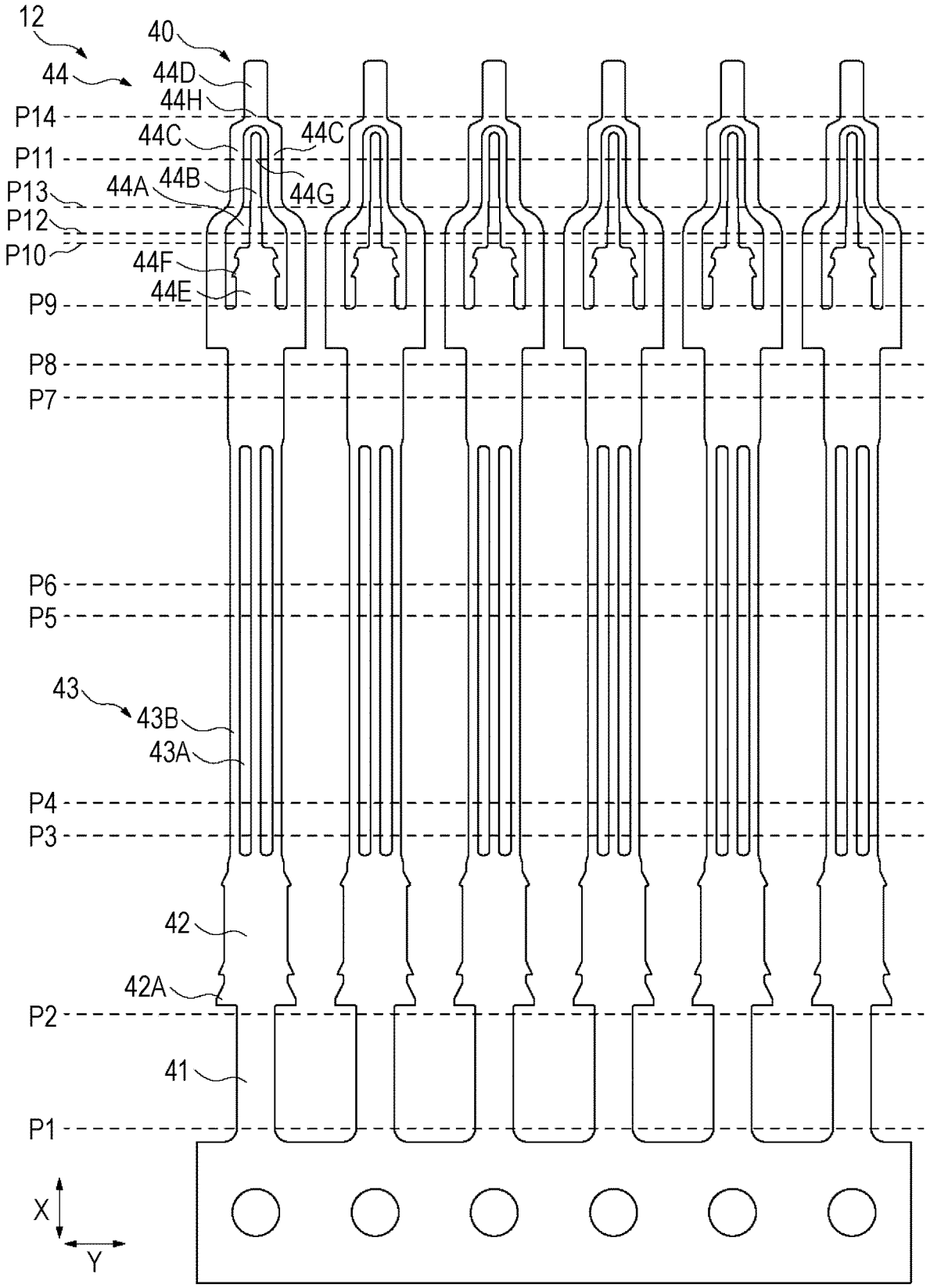
FIG. 11 is a plan view illustrating a conductor strip before forming a terminal of the connector of the embodiment of the present invention.
Figure 12:
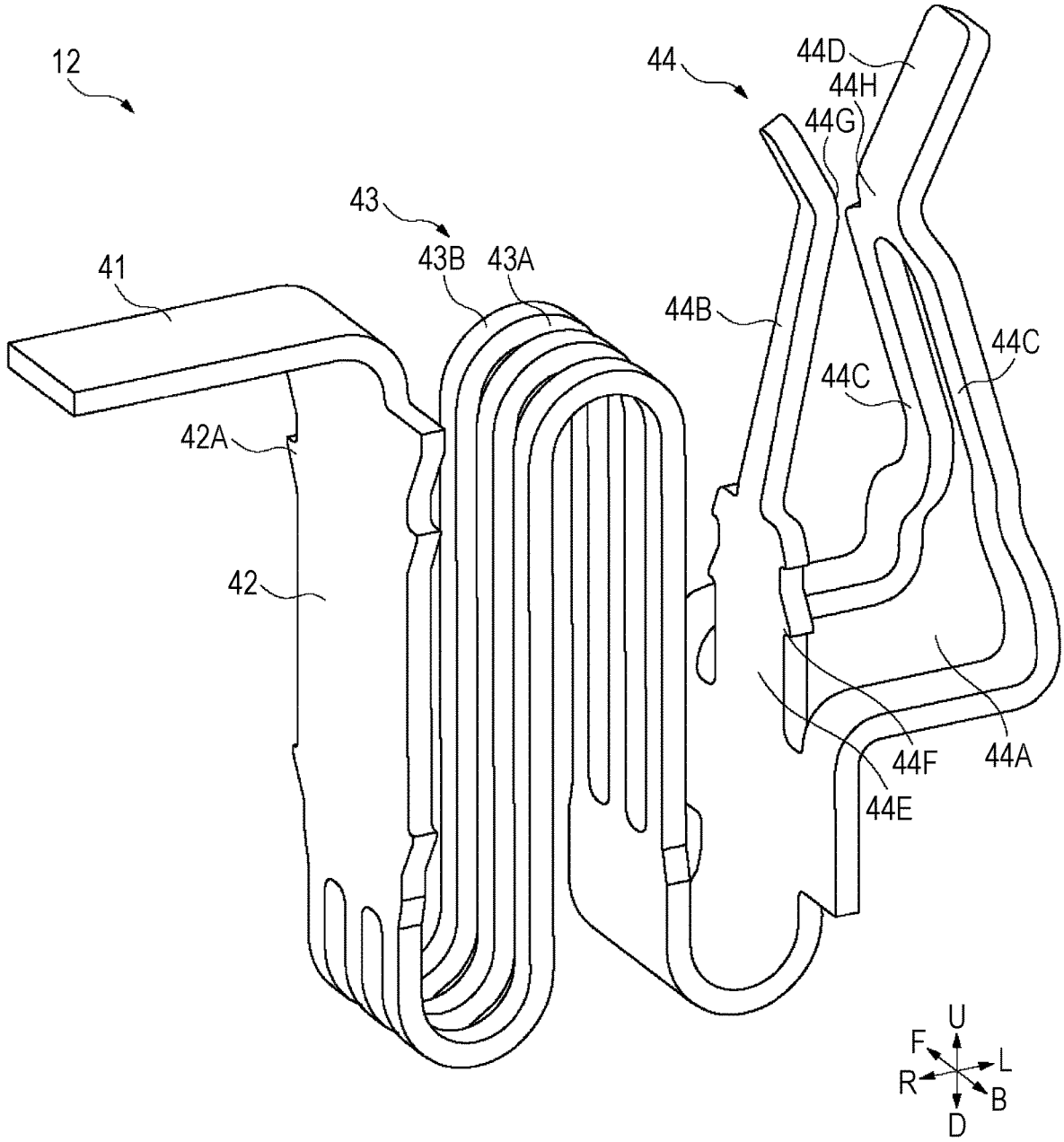
FIG. 12 is a perspective view illustrating the terminal of the connector of the embodiment of the present invention from a back side.
Figure 13:
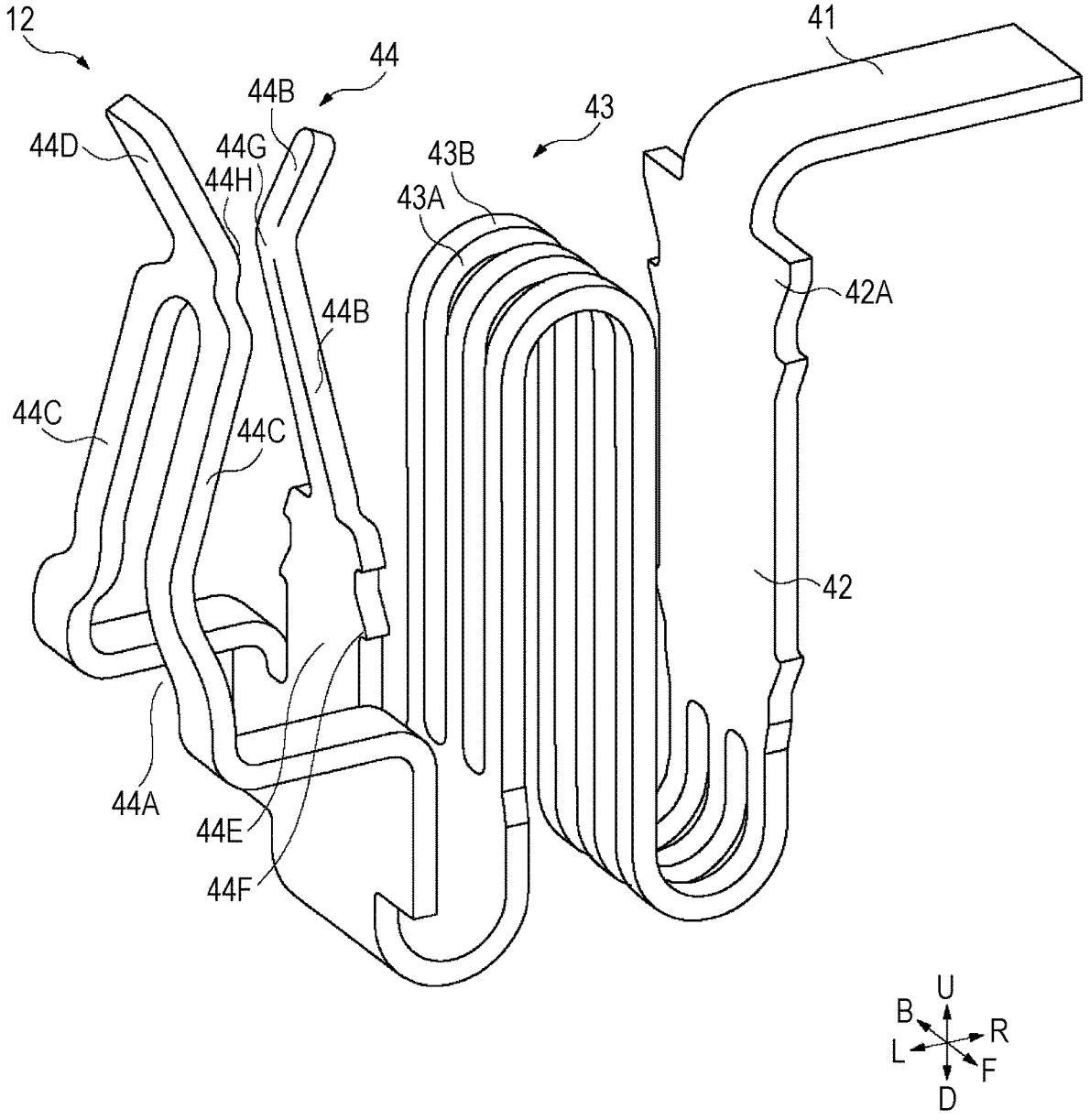
FIG. 13 is a perspective view illustrating the terminal of the connector of the embodiment of the present invention from a front side.

Since the terminals 12 have the same configuration, one terminal 12 will be described below. The terminal 12 is formed by bending a conductor strip 40 made of a flat metal or the like a plurality of times, and as illustrated in FIGS. 11 to 13, includes the connecting portion 41, the support portion 42, a spring portion 43 and the contact portion 44. FIG. 11 is a plan view of the conductor strip 40 before forming the terminal 12, FIG. 12 is a perspective view of the terminal 12 as seen from the back side, and FIG. 13 is a perspective view of the terminal 12 as seen from the front side.

As illustrated in FIG. 11, the conductor strip 40 is an elongated strip in which the longitudinal direction is an X direction perpendicular to its thickness direction and the short direction is a Y direction perpendicular to the thickness direction and the X direction. By performing press working or the like on one conductor flat plate, a plurality of conductor strips 40 arranged at predetermined intervals in the Y direction can be produced by die-cutting from the one conductor flat plate. The conductor strips 40 can be separated at a position P1 in the X direction, and the conductor strips 40 may be separated after forming the terminals 12, or the terminals 12 may be formed after separating the conductor strips 40.

At the time of production of the conductor strip 40, the connecting portion 41, the support portion 42, the spring portion 43 and the contact portion 44 are formed in the same plane and are arranged in this order in the X direction. In the following description, it is assumed that the contact portion 44 is formed at one end of the conductor strip 40 in the X direction, and the connecting portion 41 is formed at the other end in the X direction.

The connecting portion 41 is formed in a rectangular shape extending in the X direction. The support portion 42 is continuous from the connecting portion 41, has a wider width in the Y direction than the connecting portion 41 and the spring portion 43, and has a support claw 42A on its end surface in the Y direction.

The spring portion 43 is continuous from the support portion 42, and divided into a plurality of spring elements 43B by forming a plurality of slits 43A penetrating the conductor strip 40 in the thickness direction and extending in the X direction. Each spring element 43B has a structure as an elongated leaf spring, so that the spring portion 43 is easily elastically deformed not only in the thickness direction but also in the X direction.

The contact portion 44 is continuous from the spring portion 43, and branched into three branches of a first branch piece 44B at a center in the Y direction and two second branch pieces 44C on both sides in the Y direction by forming an inverted U-shaped cutout 44A penetrating the conductor strip 40 in the thickness direction. At the time of the production of the conductor strip 40, the first branch piece 44B and the two second branch pieces 44C are formed in the same plane, and the first branch piece 44B is housed between the two second branch pieces 44C.

The two second branch pieces 44C are formed to be longer than the first branch piece 44B in the X direction, and join one contact piece 44D on one end side of the first branch piece 44B in the X direction. The first branch piece 44B has a locking portion 44E wide in the Y direction on the other end side in the X direction, and the locking portion 44E includes a locking claw 44F on its end surface in the Y direction. Further, the first branch piece 44B includes a first contact point portion 44G in contact with the mating terminal 51 on the one end side in the X direction. The two second branch pieces 44C are formed to be separated wider than the width of the mating terminal 51 in the Y direction. The contact piece 44D includes a second contact point portion 44H that contacts the mating terminal 51. The mating terminal 51 is inserted between the first contact point portion 44G and the second contact point portion 44H with respect to the contact portion 44.

Formation of the terminal 12 from the conductor strip 40 will be described. The terminal 12 is formed by bending the conductor strip 40 in the Y direction at a plurality of positions P2 to P14 in the X direction without bending the conductor strip 40 in the X direction or the thickness direction. The formed terminal 12 includes the contact portion 44 urged to a side close to the mating terminal 51 to be inserted. In the following, an example will be described in which the conductor strip 40 disposed with one end in the X direction on the left side and the other end in the X direction on the right side is bent in order from a right bending position.

At a right end of the conductor strip 40, the connecting portion 41 is disposed to extend in the left-right direction, and the conductor strip 40 is bent substantially vertically downward at the position P2, so that the support portion 42 continuous from the connecting portion 41 is disposed to extend in the up-down direction.

In the conductor strip 40, the spring portion 43 is continuous from the support portion 42. The spring portion 43 is bent to the left at the position P3, bent to extend upward from the position P4, bent to the right at the position P5, bent to extend downward from the position P6, and bent to the left at the position P7, and then bent to extend upward from the position P8.

In this way, at the terminal 12, since the spring portion 43 is bent to reciprocate a plurality of times, a longer spring portion 43 (the spring elements 43B) can be used, the spring portion 43 can be easily elastically deformed in any direction of the up-down direction, the front-rear direction, and the left-right direction, and a space occupied by the spring portion 43 can be reduced. Bending from the position P3 up to the position P4, bending from the position P5 up to the position P6, and bending from the position P7 up to the position P8 may be performed by bending in an arc shape.

In the conductor strip 40, the contact portion 44 is continuous from the spring portion 43. The contact portion 44 is formed by bending the first branch piece 44B, the two second branch pieces 44C and the contact piece 44D at different positions in the X direction, in the Y direction (based on bending lines in the Y direction). The first branch piece 44B is bent in a different direction from the two second branch pieces 44C and the contact piece 44D so as to be separated from each other, so that the mating terminal 51 can be inserted between the first branch piece 44B and the two second branch pieces 44C and the contact piece 44D. After the first branch piece 44B and the two second branch pieces 44C are separated from each other as described above, the first contact point portion 44G of the first branch piece 44B and the second contact point portion 44H of the contact piece 44D are bent to be close to the mating terminal 51. The first branch piece 44B, the two second branch pieces 44C and the contact piece 44D may be formed so that the mating terminal 51 is sandwiched between the first contact point portion 44G and the second contact point portion 44H.

Specifically, the contact portion 44 is branched into three branches of the first branch piece 44B and the two second branch pieces 44C at the position P9. The first branch piece 44B is disposed to continuously extend upward from the spring portion 43 even after passing through the position P9, and bent to the left at the position P10 and then bent to the right at the position P11. The first contact point portion 44G is provided at the position P11 of the first branch piece 44B.

The second branch pieces 44C are bent substantially vertically to the left at the position P9, bent substantially vertically upward at the position P12, and bent to the right at the position P13, and then join the contact piece 44D. The contact piece 44D is bent to the left at the position P14. The second contact point portion 44H is provided at the position P14 of the contact piece 44D. In this way, the terminals 12 are formed as illustrated in FIGS. 12 and 13.

In the formed terminal 12, upper ends of the first branch piece 44B and the contact piece 44D are separated from each other in the left-right direction, and gradually approach each other in the left-right direction downward from the upper ends. In other words, the upper ends of the first branch piece 44B and the contact piece 44D are formed to gradually separate from each other upward in the left-right direction. This makes a structure in which the mating terminal 51 to be inserted from above can be easily guided.

The first branch piece 44B and the contact piece 44D are close to each other in the left-right direction at the first contact point portion 44G and the second contact point portion 44H provided at the same position in the up-down direction. The first branch piece 44B and the second branch pieces 44C are located below a position in which the first contact point portion 44G and the second contact point portion 44H are close to each other, and urge the first contact point portion 44G and the second contact point portion 44H to come close to each other against a force in a direction in which the first contact point portion 44G and the second contact point portion 44H are separated from each other.

A spring portion extending from the locking portion 44E to the first contact point portion 44G in the first branch piece 44B and a spring portion extending from a branch position to the second contact point portion 44H in each second branch piece 44C have different spring constants (spring strengths) depending on their lengths and widths. The spring constants of the spring portion of the first branch piece 44B and the spring portion of each second branch piece 44C are different as a whole and are also partially different. For example, by forming the first branch piece 44B short to increase the spring constant, elastic deformation is less likely to occur, so that an urging force can be increased. The second branch piece 44C tends to have a smaller spring constant by forming it longer, but by forming it wider to increase the spring constant, the elastic deformation is less likely to occur, so that the urging force can be increased. Further, by providing the two second branch pieces 44C to increase the number of springs, the spring constant is increased as a whole, so that the urging force can be increased. Based on the above relationship, the first branch piece 44B and the two second branch pieces 44C can be formed to have the same spring constant to exert the same urging force. Alternatively, the first branch piece 44B and the two second branch pieces 44C may be formed so that the spring constant of either one is made larger and the urging force of either one is made stronger.

The first branch piece 44B and each second branch piece 44C are gradually separated downward in the left-right direction below the position in which the first contact point portion 44G and the second contact point portion 44H are close to each other. Since the locking portion 44E stands upward on a lower end side of the first branch piece 44B, the first branch piece 44B is difficult to deform in the left-right direction. On the other hand, since the second branch pieces 44C are inclined toward the first branch piece 44B standing upward on the lower end side, an inclination angle can be made sharper, and it is difficult to deform in a direction away from the first branch piece 44B. Further, since the first branch piece 44B and the second branch pieces 44C are connected to each other on an inner side in the insertion direction of the mating terminal 51, they are difficult to separate in the left-right direction regardless of insertion of the mating terminal 51. Therefore, the first contact point portion 44G and the second contact point portion 44H respectively urged by the first branch piece 44B and the second branch pieces 44C are also difficult to separate in the left-right direction.

Attachment of the terminal 12 to the fixed housing 10 and the movable housing 11 will be described. First, the contact portion 44 of the terminal 12 is inserted into the insertion portion 30 of the movable housing 11 from below the movable housing 11. At this time, the locking portion 44E of the first branch piece 44B of the contact portion 44 is made to enter the locking groove 30A, so that the locking claw 44F of the locking portion 44E is locked in the locking groove 30A. Further, the first branch piece 44B is made to enter the right locking hole 34 from an inside of the insertion portion 30, and the contact piece 44D of the contact portion 44 is made to enter the left locking hole 32 from the inside of the insertion portion 30.

Thus, the contact portion 44 is locked to the movable housing 11, and the movable housing 11 is attached to the terminal 12. The inside of the insertion portion 30 penetrates between the first branch piece 44B and the contact piece 44D, between the first branch piece 44B and the second branch pieces 44C, and between the two second branch pieces 44C when viewed from above. Further, a part of the spring portion 43 continuous from the contact portion 44 is housed between the pair of right protrusions 33 of the movable housing 11.

Subsequently, the terminal 12 to which the movable housing 11 is attached is housed in the housing portion 13 of the fixed housing 10 from above the fixed housing 10. At this time, while the support portion 42 of the terminal 12 is made to enter the right recess 22 of the housing portion 13, it is made to enter the support groove 24 of the housing portion 13, to lock the support claw 42A of the support portion 42 to the support groove 24. Further, the connecting portion 41 of the terminal 12 is disposed in the upper recess 23 of the housing portion 13, to expose a right end of the connecting portion 41 to the right side of the fixed housing 10. Thus, the connecting portion 41 and the support portion 42 are fixed to the fixed housing 10, and the terminal 12 is fixed to the fixed housing 10.

A bent portion from the position P3 to the position P4 of the spring portion 43 of the terminal 12 may be housed in the spring housing hole 15 of the fixed housing 10, and a bent portion from the position P7 to the position P8 of the spring portion 43 of the terminal 12 may be housed in the through-hole 14 of the fixed housing 10.

Further, the movable housing 11 attached to the terminal 12 is also housed in the housing portion 13 of the fixed housing 10 from above the fixed housing 10. At this time, the left protrusion 31 of the movable housing 11 is housed in the left recess 20 of the housing portion 13. Further, the insertion portion 30 of the movable housing 11 and the through-hole 14 correspond to each other and communicate with each other in the up-down direction. Thus, the spring portion 43 supports the contact portion 44 and the movable housing 11 movably with respect to the fixed housing 10.

A connection between the connector 1 and the mating connector 2 will be described. When the connector 1 and the mating connector 2 are connected, the contact portions 52 of the mating terminals 51 of the mating connector 2 are inserted into the insertion portions 30 of the movable housings 11 of the connector 1 from above. At this time, the mating terminal 51 is guided downward inside the insertion portion 30 by a widened shape of the upper end of the insertion portion 30. Further, the mating terminal 51 is inserted toward the contact portion 44 of the terminal 12 inside the insertion portion 30, and is guided downward by a separating shape of the upper ends of the first branch piece 44B and the contact piece 44D of the contact portion 44. Then, the mating terminal 51 is inserted between the first contact point portion 44G and the second contact point portion 44H, and the contact portion 52 comes into contact with the first contact point portion 44G and the second contact point portion 44H.

When the mating terminal 51 is formed longer than the connector 1 in the up-down direction, the mating terminal 51 is inserted through below the position in which the first contact point portion 44G and the second contact point portion 44H are close to each other at the contact portion 44 of the terminal 12. The mating terminal 51 can pass between the first branch piece 44B and the second branch pieces 44C, and can pass between the two second branch pieces 44C. Further, the mating terminal 51 can also penetrate the insertion portion 30 of the movable housing 11 and penetrate downward from the through-hole 14. Therefore, the mating terminal 51 can be formed longer without being limited in design.

A position of the mating connector 2 with respect to the connector 1 may be misaligned, or a position of the mating terminal 51 with respect to the insertion portion 30 of the movable housing 11 or the contact portion 44 of the terminal 12 may be misaligned. In this case, when the mating terminal 51 to be inserted comes into contact with the movable housing 11 or the terminal 12, depending on an amount of misalignment between the mating terminal 51 and the movable housing 11 or the terminal 12, the spring portion 43 of the terminal 12 is elastically deformed, and the movable housing 11 moves in the left-right direction, the front-back direction, or the up-down direction with respect to the fixed housing 10.

When the mating terminals 51 and the movable housings 11 or the terminals 12 are misaligned in different directions, each terminal 12 is elastically deformed and each movable housing 11 moves according to the misalignment. Therefore, the misalignment of the contact portions 52 of the mating terminals 51 of the mating connector 2 with respect to the contact portions 44 of the terminals 12 of the connector 1 is absorbed, so that good connections between the terminals 12 of the connector 1 and the mating terminals 51 of the mating connector 2 are ensured.

As described above, the connector 1 according to the present embodiment includes the terminals 12 respectively corresponding to the mating terminals 51 of the mating connector 2, the movable housings 11 for respectively holding the contact portions 44, that are one ends of the terminals 12 respectively in contact with the mating terminals 51, and the fixed housing 10 that is fixed to the mounting target such as the substrate 3 and houses the movable housings 11. Then, the connecting portions 41 that are the other ends of the terminals 12, are fixed to the fixed housing 10. The terminals 12 respectively operate independently of the mating terminals 51, to movably support the movable housings 11 with respect to the fixed housing 10.

Thus, even when the mating terminals 51 and the movable housings 11 or the terminals 12 are misaligned in different directions, the terminals 12 can individually move the movable housings 11 in response to the misalignments of the mating terminals 51. Therefore, it is possible to absorb the misalignments of the contact portions 52 of the mating terminals 51 of the mating connector 2 with respect to the contact portions 44 of the terminals 12 of the connector 1, and to ensure the good connections between the terminals 12 of the connector 1 and the mating terminals 51 of the mating connector 2 without causing poor contact between the contact portions 44 of the terminals 12 and the contact portions 52 of the mating terminals 51.

Further, with the connector 1 according to the present embodiment, the terminals 12 are formed by bending the conductor strip 40 in the Y direction that is the short direction at the positions in the X direction that is the longitudinal direction, so that the contact portions 44 urged to the side close to the mating terminals 51 are formed.

Thus, in order to form the contact portion 44, the conductor strip 40 does not have to be long in the Y direction, but only needs to be long in the X direction, so that more conductor strips 40 can be formed in the Y direction in one conductor flat plate. Therefore, the number of terminals 12 to be produced can be increased, and the production efficiency and production cost of the terminals 12 can be improved. Further, it is not necessary to bend the conductor strip 40 along a bending line in the X direction, and the terminal 12 can be formed by bending along only the bending lines in the Y direction, which can improve the work efficiency.

With the connector 1 according to the present embodiment, for example, the contact portion 44 has the first branch piece 44B, and the two second branch pieces 44C on both sides of the first branch piece 44B, that are obtained by branching the conductor strip 40 into three branches, and the contact piece 44D that the two second branch pieces 44C join. The first branch piece 44B and the contact piece 44D respectively have the first contact point portion 44G and the second contact point portion 44H that come into contact with the mating terminal 51. The second branch pieces 44C are formed longer than the first branch piece 44B in the longitudinal direction. The first branch piece 44B and the second branch pieces 44C are bent in different directions so as to be separated from each other, and then bent so that the first contact point portion 44G and the second contact point portion 44H are brought close to each other.

Thus, the urging force can be increased by shortening the first branch piece 44B, and by providing two long second branch pieces 44C, so that the first contact point portion 44G and the second contact point portion 44H can be brought closer to the mating terminal 51 more firmly by the first branch piece 44B and the second branch pieces 44C. Therefore, a force with which the contact portion 44 of the terminal 12 contacts the contact portion 52 of the mating terminal 51 can be increased, and the poor contact between the contact portion 44 and the contact portion 52 can be suppressed.

Further, with the connector 1 according to the present embodiment, the movable housing 11 is formed so that the mating terminal 51 can be inserted thereinto. Further, the two second branch pieces 44C are provided to be separated wider than the width of the mating terminal 51 in the short direction.

Thus, even when the mating terminal 51 is formed longer than the movable housing 11, the movable housing 11 and the terminal 12 can receive the insertion of the mating terminal 51 and allow it to penetrate them. Therefore, the design of the mating terminal 51 and the contact portion 52 is not limited, and the degree of freedom in designing the mating connector 2 can be increased, so that the connector 1 can accept various mating connectors 2.

In the above embodiment, an example has been described in which the connecting portion 41 of the terminal 12 is fixed on the upper end side of the connector 1, to fix the upper end of the connector 1 to the mounting target such as the substrate 3, in a structure in which the mating terminal 51 of the mating connector 2 is inserted into the movable housing 11 and the terminal 12 of the connector 1 from above, however, the present invention is not limited to this example. For example, in another embodiment, the connecting portion 41 of the terminal 12 may be fixed on the lower end side of the connector 1, in a structure in which the mating terminal 51 of the mating connector 2 is inserted into the movable housing 11 and the terminal 12 of the connector 1 from above. In this case, the lower end of the connector 1 may be sufficiently fixed to the mounting target such as the substrate 3.

In the above embodiment, an example has been described in which the connector 1 is disposed on the lower side and the mating connector 2 is disposed on the upper side, and the mating terminal 51 of the mating connector 2 is inserted into the movable housing 11 and the terminal 12 of the connector 1 from above, however, the present invention is not limited to this example. For example, in another embodiment, the connector 1 may be dispose on the upper side and the mating connector 2 may be disposed on the lower side, and the mating terminal 51 of the mating connector 2 may be inserted into the movable housing 11 and the terminal 12 of the connector 1 from below.

The present invention can be appropriately modified to the extent that it does not contradict the gist or spirit of the invention that can be read from the claims and the entire specification, and the connector with such a modification is also included in the technical spirit of the present invention.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising:

a plurality of terminals respectively corresponding to a plurality of mating terminals of a mating connector;

a plurality of movable housings respectively holding one ends of the terminals respectively in contact with the plurality of mating terminals; and a fixed housing fixed to a mounting target and housing the plurality of movable housings, wherein other ends of the plurality of terminals are fixed to the fixed housing, and the plurality of terminals operates independently with respect to the plurality of mating terminals, and thus respectively support the plurality of movable housings movably with respect to the fixed housing, each of the terminals is formed by bending a conductor strip in its short direction at a plurality of positions in its longitudinal direction, to form a contact portion urged to a side closer to each of the mating terminals, the contact portion has a first branch piece, and two second branch pieces on both sides of the first branch piece, that are obtained by branching the conductor strip into three branches, and a contact piece that the two second branch pieces join, the first branch piece and the contact piece respectively have a first contact point portion and a second contact point portion that contact the mating terminals, the second branch pieces are formed to be longer than the first branch piece in the longitudinal direction, and the first branch piece and the second branch pieces are bent in different directions so as to be separated from each other, and then bent so that the first contact point portion and the second contact point portion are brought close to each other.

2. The connector according to claim 1, wherein the movable housings are formed so that the mating terminals can be inserted thereinto, and the two second branch pieces are provided to be separated wider than a width of each of the mating terminals in the short direction.

* * * * *